US007503079B1

(12) United States Patent
Fletcher et al.

(10) Patent No.: US 7,503,079 B1
(45) Date of Patent: Mar. 17, 2009

(54) SCARF WITH MULTI-PURPOSE WEIGHTED SECURING MEANS

(76) Inventors: Lynn Fletcher, 6960 Birch St., Falls Church, VA (US) 22046; Linda Rohrbach, 904 Douglas Dr., McLean, VA (US) 22101

( * ) Notice: Subject to any disclaimer, the term of this patent is extended or adjusted under 35 U.S.C. 154(b) by 1032 days.

(21) Appl. No.: 09/907,706

(22) Filed: Jul. 19, 2001

(51) Int. Cl.
*A42B 5/00* (2006.01)

(52) U.S. Cl. ..... 2/207

(58) Field of Classification Search ..... 2/207, 2/244, 208, 311, 321, 171, 609, 500, 600; 24/49; 446/26, 27, 28, 71, 72; D2/501; 273/415; 16/1 R, DIG. 8
See application file for complete search history.

(56) References Cited

U.S. PATENT DOCUMENTS

| | | | | | |
|---|---|---|---|---|---|
| 64,230 | A | | 4/1867 | Laighton | |
| 113,748 | A | | 4/1871 | Dexter | |
| 120,487 | A | | 10/1871 | Brody | |
| 213,139 | A | | 3/1879 | Silberstein | |
| 1,324,730 | A | * | 12/1919 | Lichtenstein | |
| 1,405,744 | A | * | 2/1922 | Sampliner | |
| 1,448,811 | A | | 3/1923 | Morrison | |
| 1,896,060 | A | | 1/1933 | Colby | |
| 1,897,333 | A | | 2/1933 | Resseguie | |
| 2,628,452 | A | * | 2/1953 | Gladstein | 446/28 |
| 2,660,731 | A | | 12/1953 | Dunning | |
| 3,087,277 | A | * | 4/1963 | McCook | 446/27 |
| 3,889,313 | A | | 6/1975 | Hulthen | |
| 4,038,724 | A | | 8/1977 | Parizek | |
| 4,197,604 | A | * | 4/1980 | Nakamura | 5/437 |
| 4,488,315 | A | * | 12/1984 | Hoerlein | 2/91 |
| 4,498,613 | A | * | 2/1985 | Donahue et al. | 224/251 |
| D279,727 | S | * | 7/1985 | Mitchell | D2/343 |
| 4,543,669 | A | * | 10/1985 | Katz | 2/84 |
| D289,227 | S | | 4/1987 | Glynn | |
| 4,754,512 | A | * | 7/1988 | Chao-Yang | 5/482 |
| 4,776,049 | A | * | 10/1988 | Perron | 5/436 |
| 4,805,619 | A | | 2/1989 | Swearingen | |
| D305,844 | S | * | 2/1990 | Chang | D6/598 |
| 4,975,987 | A | * | 12/1990 | Teachout et al. | 2/246 |
| D315,640 | S | * | 3/1991 | Pelzel | D3/230 |
| D318,503 | S | * | 7/1991 | Danova | D21/605 |
| 5,046,980 | A | * | 9/1991 | Tai et al. | 446/73 |
| 5,136,726 | A | * | 8/1992 | Kellin et al. | 2/244 |
| 5,169,701 | A | * | 12/1992 | Sander | 428/79 |
| 5,388,598 | A | | 2/1995 | Whitten | |
| 5,440,787 | A | | 8/1995 | Figueroa et al. | |
| 5,454,121 | A | | 10/1995 | Mellinger | |
| 5,513,392 | A | * | 5/1996 | Douglas et al. | 2/207 |

(Continued)

FOREIGN PATENT DOCUMENTS

WO PCT/US88/02605 * 4/1988

*Primary Examiner*—Alissa L Hoey
(74) *Attorney, Agent, or Firm*—Nixon Peabody LLP; Jeffrey L. Costellia

(57) ABSTRACT

An improved scarf having weighted objects fixedly or removably attached to the ends thereof to provide a means for securing the scarf to a wearer's body without the need for means for securing the ends of the scarf together. The improved scarf also provides a hand-free means for carrying toys and an attractive means for encouraging people to wear a scarf. Further, the improved scarf provides a means to make a scarf more distinguishable so as to make it easier to identify.

8 Claims, 7 Drawing Sheets

U.S. PATENT DOCUMENTS 5,542,122 A * 8/1996 Moldovan ..... 2/69
D376,252 S * 12/1996 Herring-Stanger ..... D2/500
5,713,080 A 2/1998 Tate
5,720,049 A 2/1998 Clutton
5,903,924 A * 5/1999 Garbit ..... 2/207
5,933,866 A * 8/1999 Fox ..... 2/115
D431,892 S 10/2000 Maratta
6,233,763 B1 * 5/2001 Spaan ..... 5/485
6,279,167 B1 * 8/2001 Johnson et al. ..... 2/209.13
6,427,267 B1 * 8/2002 Turner ..... 5/482
D486,952 S * 2/2004 Szurley ..... D2/500
6,688,305 B1 * 2/2004 Perry ..... 128/202.16

* cited by examiner

SCARF WITH MULTI-PURPOSE WEIGHTED SECURING MEANS

FIELD OF THE INVENTION

This invention relates to an article of clothing worn about the neck. In particular, the invention relates to neckwear with weighted ornamental or interactive toys attached to the neckwear.

PRIOR ART

U.S. Pat. No. 5,720,049 to Clutton discloses a scarf having two ends that are releasably held together by weighted attachment means to secure the scarf by making a loop about an individual. As illustratively shown in FIGS. 1A and 1B, Clutton teaches cup members 101 and 102 attached to each end of a scarf, and barrel members 107 and 108 made of relatively weighty material attached to the cup members 101 and 102, respectively. Further, the barrel members are screwed onto each other so that the scarf is formed into a closed loop around a wearer's neck when in use. Clutton, however, fails to teach or suggest a means to keep the scarf in place without either a cup and barrel apparatus or without attaching one end of the scarf to the other. Further, Clutton also fails to teach or suggest a decorative ornament that is an amusement toy.

In another example, U.S. Pat. No. 5,713,080 to Tate teaches a clothing ornamentation device 210 that includes weighty ornaments 236 and 238 and a secure element 212 for attaching the ornamentation device 210 to an upper portion of a wearer's garment 214. FIGS. 2A, 2B, and 2C are exemplary illustrations of the clothing ornamentation device of Tate. The ornamentation device 210 is draped over a garment for decorative purposes. The device of Tate is a clothing decorative accessory that is secured to a clothing at the neck area by the secure element 212. The ornamentation device of Tate can be used to drape over various types of clothing articles; however, the ornamentation device does not provide any warmth, and it is not a toy or a toy carrier.

SUMMARY OF THE INVENTION

Therefore there is a need for a clothing article, which provides warmth and decoration as that of a conventional scarf but in addition has functional devices having decorative value attached to each end of a scarf.

An object of the instant invention is to provide a new and improved scarf with a hands-free means for conveying toys.

Another object of the instant invention is to provide, at each end of the scarf, an interactive toy and/or an ornamental toy for either children or adults to play.

Still another object of the instant invention is to provide an object at each end of a scarf, wherein the objects at each end are approximately evenly weighted so as to hold the scarf in place on a wearer's body and to keep it from falling off without having to tie or otherwise attach the ends together.

Yet another object of the instant invention is to provide an improved scarf that requires no fastener to secure the scarf to a wearer's body.

It is still another object of the instant invention to provide a scarf with a multi-purpose weighted objects attached that serve a interactive or ornamental toys and means for securing a scarf to a body.

It is still another object of the invention to provide a scarf with weight attachments that effectively hold the scarf on a wearer's body, wherein the total weight of the objects attached to the scarf that effectively holds the scarf in place preferably is in the range of about half an ounce to 32 ounces, more preferably in the range of about 1 ounce to 12 ounces, and even more preferably in the range of about 2 ounces to 8 ounces.

As described below, the present invention provides advantages over prior art scarves. For example, the present invention allows the toys to be carried about in a more secured fashion. It also alleviates the need for children or adults to carry bags, backpacks, or purses to secure the toys while moving about.

Another advantage of the present invention is that the objects attached, which are specifically intended to entertain or to be interactive with the wearer, can encourage children to wear scarves for warmth and protection against the elements. The unique entertainment value of the toy attached in the present invention makes wearing a scarf more desirable and thus serves as a parental aid to keep children warm.

Yet another advantage of the present invention is that the weighted object on each end holds the scarf in place. Thus, clips, tying, or other fastening devices are not needed.

Additional advantages of the present invention will become readily apparent to those skilled in the art from the following detailed description, wherein only the preferred embodiment of the invention is shown and described, simply by way of illustration of the best mode contemplated for carrying out the present invention. As will be realized, the present invention is capable of other and different embodiments, and its several details are capable of modification in various obvious respects, all without departing from the invention. Accordingly, the drawings and description are to be regarded as illustrative nature, and not as restrictive.

BRIEF DESCRIPTION OF THE DRAWINGS

Reference is made to the attached drawings, wherein elements having the same reference numeral designations represent like elements throughout, and wherein.

DETAILED DESCRIPTION OF THE INVENTION

The present invention addresses and solves problems related to neckwear falling off a wearer's body, being indistinguishable from other neckwear, being unattractive or uninteresting to a wearer, and carrying toys hands-free.

Figure 1A:
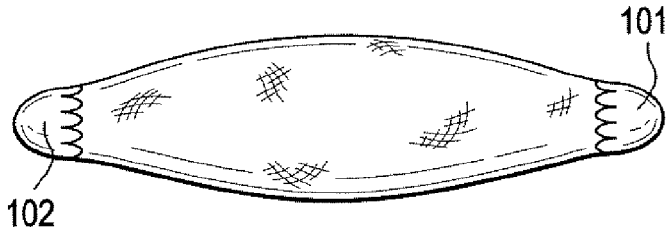
FIG. 1A (PRIOR ART)
FIG. 1A illustrates a prior art article of clothing.
Figure 1B:
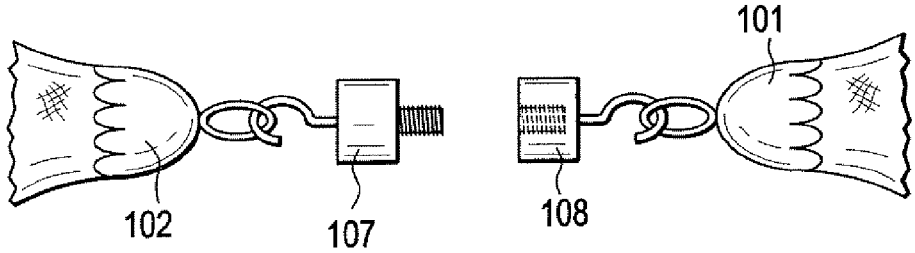
FIG. 1B (PRIOR ART)
FIG. 1B illustrates a prior art scarf securing means.
Figure 2A:
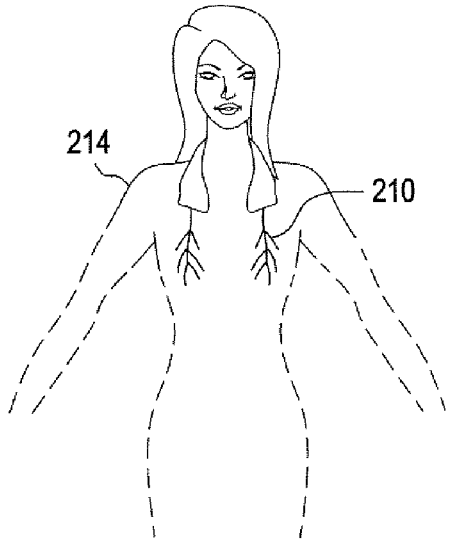
FIG. 2A PRIOR ART
FIG. 2A illustrates a prior art clothing ornamentation device.
Figure 2B:
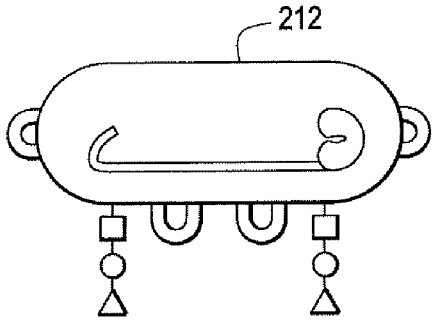
FIG. 2B PRIOR ART
FIG. 2B illustrates a prior art fastening element.
Figure 2C:
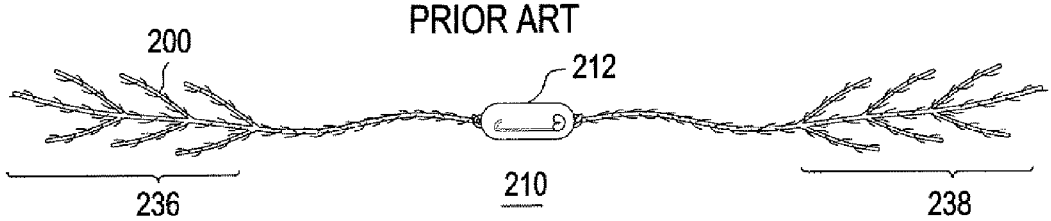
FIG. 2C PRIOR ART
FIG. 2C illustrates in further details of the clothing ornamentation device shown in FIG. 2A with weighted ornaments.
Figure 3:
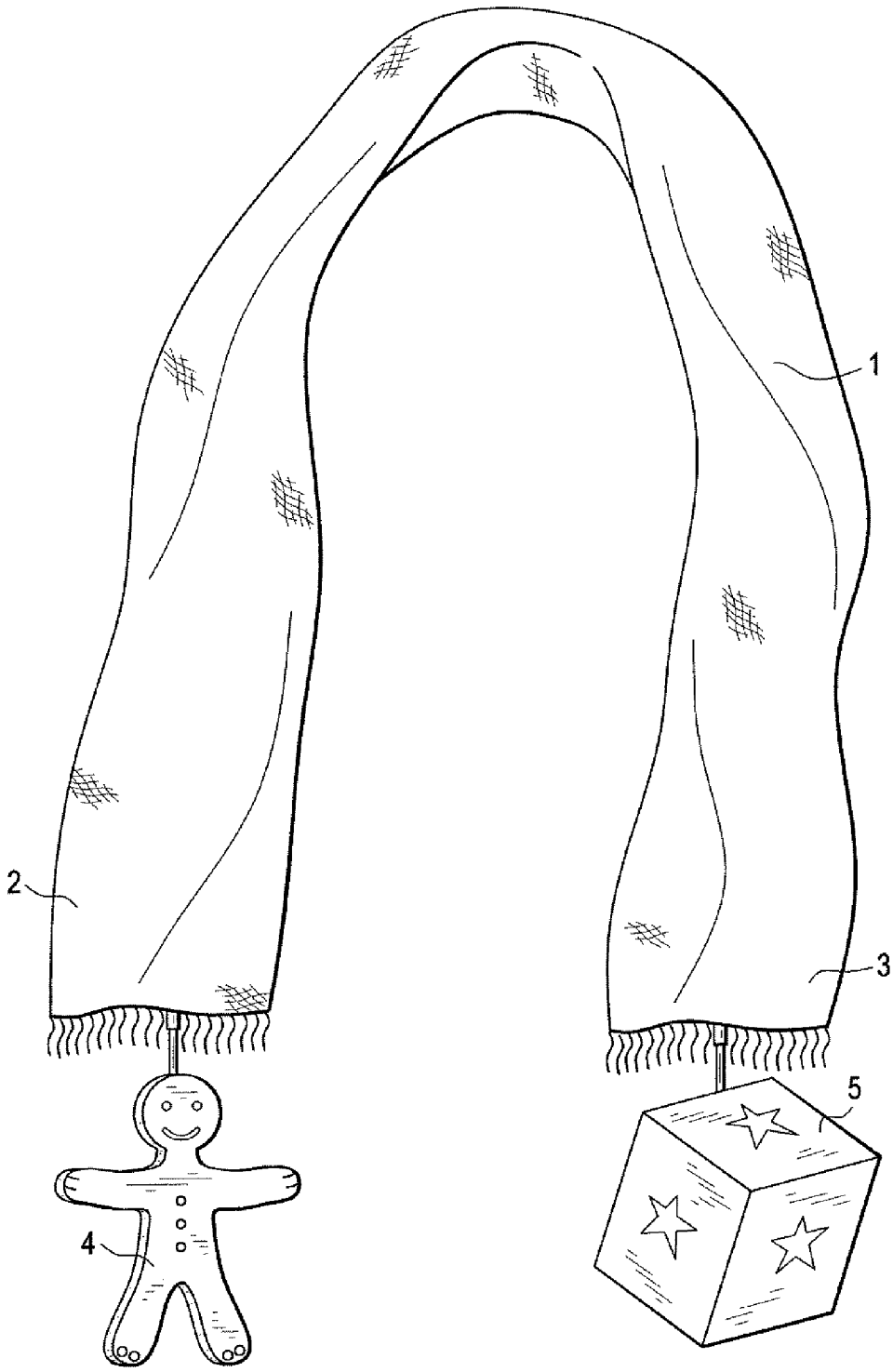
FIG. 3 illustrates an embodiment of a scarf with ornamental toys of the present invention.

Referring now to the drawings, FIG. 3 illustrates an embodiment of the present invention including a scarf 1. The scarf 1 is preferably rectangular or elongated in shape. The scarf can be made up of a material including wool, silk, cashmere, fleece, cotton, polyester, or the like. With a scarf having an elongated shape like that of scarf 1, objects 4 and 5 may be fixed or removably attached to the ends of 2 and 3 of scarf 1.

The ornamental objects attached to the scarf preferably are weighted. That is, the objects have higher density, i.e. ratio of mass, to bulk or volume, than that of the material of the scarf so as to provide a means to minimize the scarf from being blown by wind and to secure the scarf to a wearer's body.

The objects attached to the scarf are preferably ornamental toys or interactive toys, and the term objects shall be used interchangeably with toys or devices disclosed herein. The types of objects will become more apparent as the invention is being described.

Further, the objects attached to the scarf preferably have a total weight in the range of 0.5 ounce to 32 ounces, more preferably between about 1 ounce and 12 ounces, and even more preferably between about 2 ounces and 8 ounces.

Figure 6A:
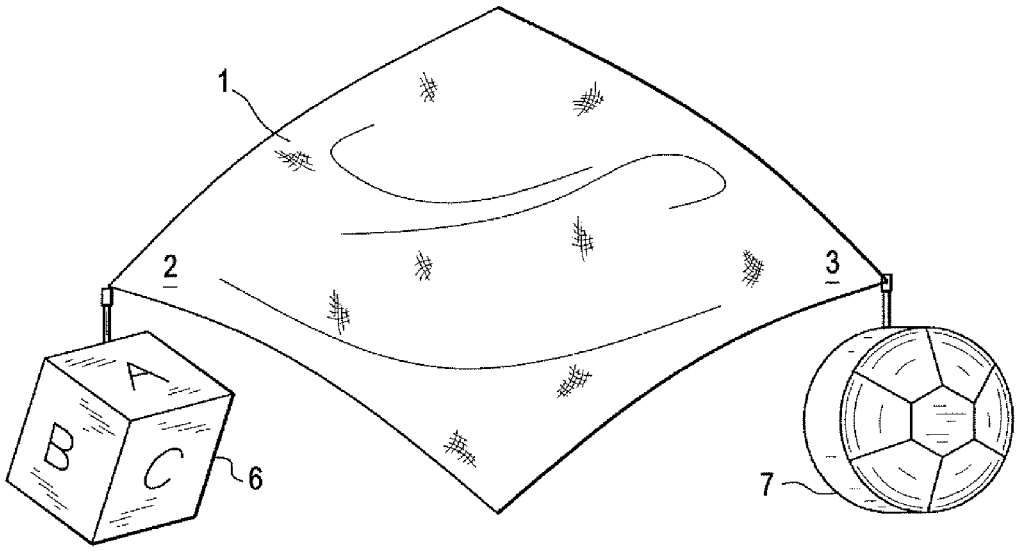
FIG. 6A illustrates yet another exemplary embodiment of the present invention.

The scarf may be of a square shape having ornamental and or interactive toys attached to opposite corners 2 and 3 as shown in FIG. 6A. The scarf may have other shapes, such as oblong or polygonal shapes.

Figure 6B:
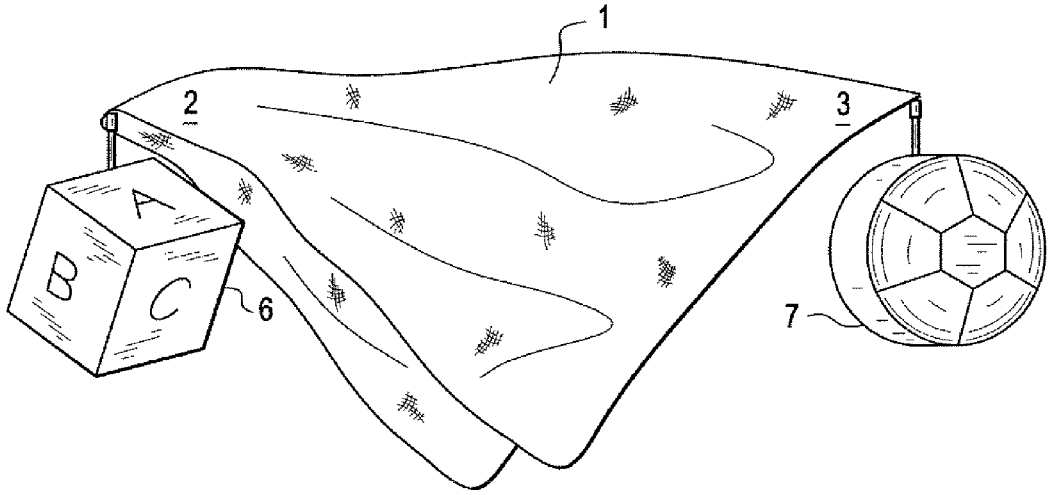
FIG. 6B illustrates another exemplary embodiment of the present invention.

The square-shaped scarf 1 of FIG. 6A may be folded as shown in FIG. 6B so that it can be wrapped around the wearer's body more easily.

The toy 6 shown in FIG. 6A may be an interactive learning device. For example, the toy 6 can be a speaking alphabet. The toy 7 in FIG. 6A can be a soft miniature soccer ball.

The objects attached to the scarf are preferably of approximately equal weight so that the scarf could be balanced on the wearer's body. Exact equal weight of each object is not essential as the scarf's fabric material provides some friction against the wearers' clothing or body to further help any unbalance in weight. Further the weighted objects are of sufficient weight so that the scarf cannot easily be blown by gusty winds but are also not overly weighty so that prolonged wearing of the scarf would not overly burden the wearer.

The objects may be affixed permanently or removably against the scarf, partly against the scarf, or partly dangling below the scarf. The weighted objects can be affixed at a location anywhere from the edge of each end of the scarf to a position that is one-fourth the total distance up from the edge of the ends of the scarf.

Figure 4:
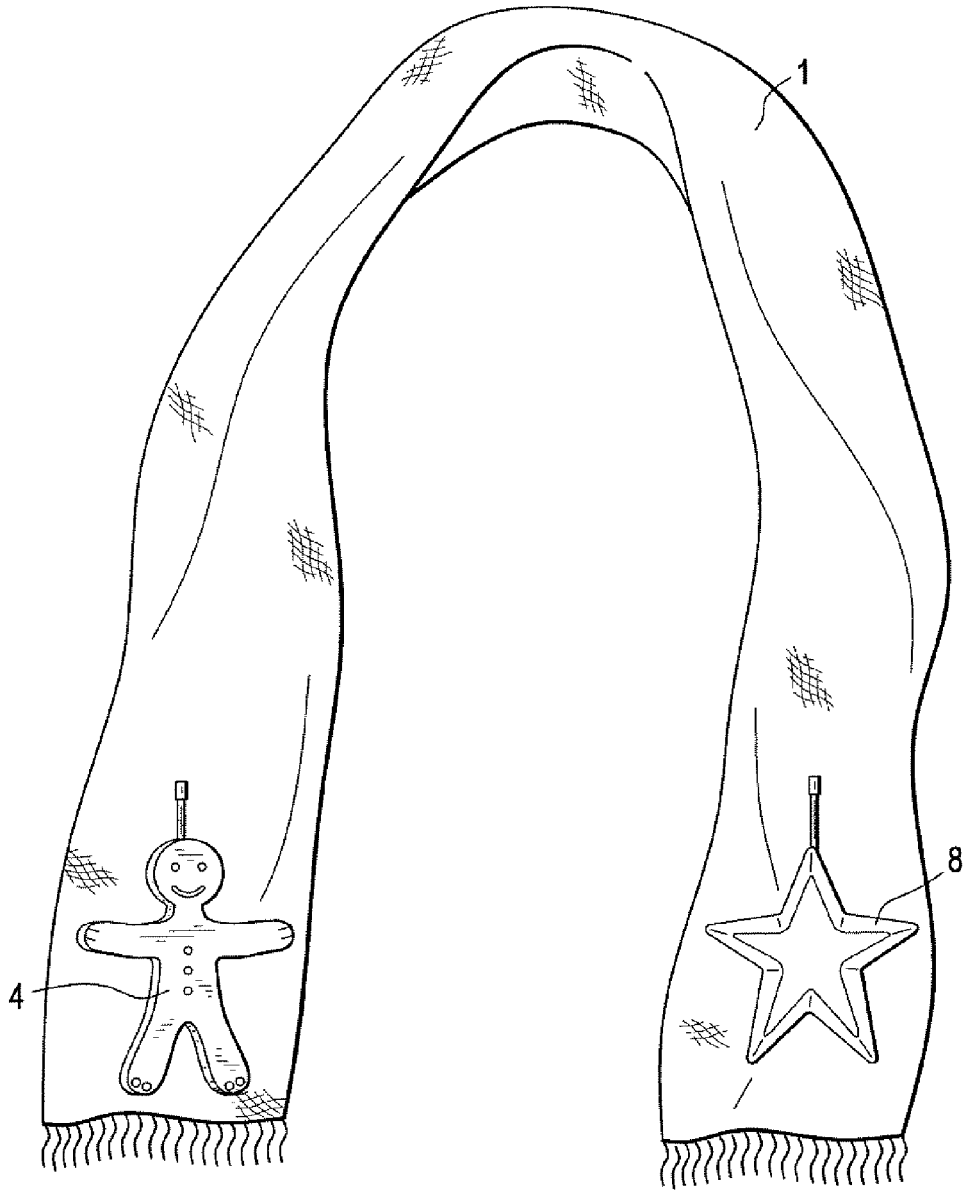
FIG. 4 illustrates another exemplary embodiment of the present invention.

FIG. 4 illustrates an example of a scarf with ornamental toys 4 and 8 attached fully against the scarf. If the toys are dangling fully below the scarf, such as shown in FIG. 3, the toy may be attached to the scarf by a string, thread, ribbon, hooks and loops, or similar connector pieces.

Further, the objects may be affixed permanently by sewing, gluing, or other attachment means. The objects may be detachably affixed to scarf 1 by hooks and loops means (i.e., Velcro™), buttons, snaps, hooks, or any other removable means. An example of an interactive electronic toy removably attached to scarf 1 can be seen in FIG. 5.

Figure 5:
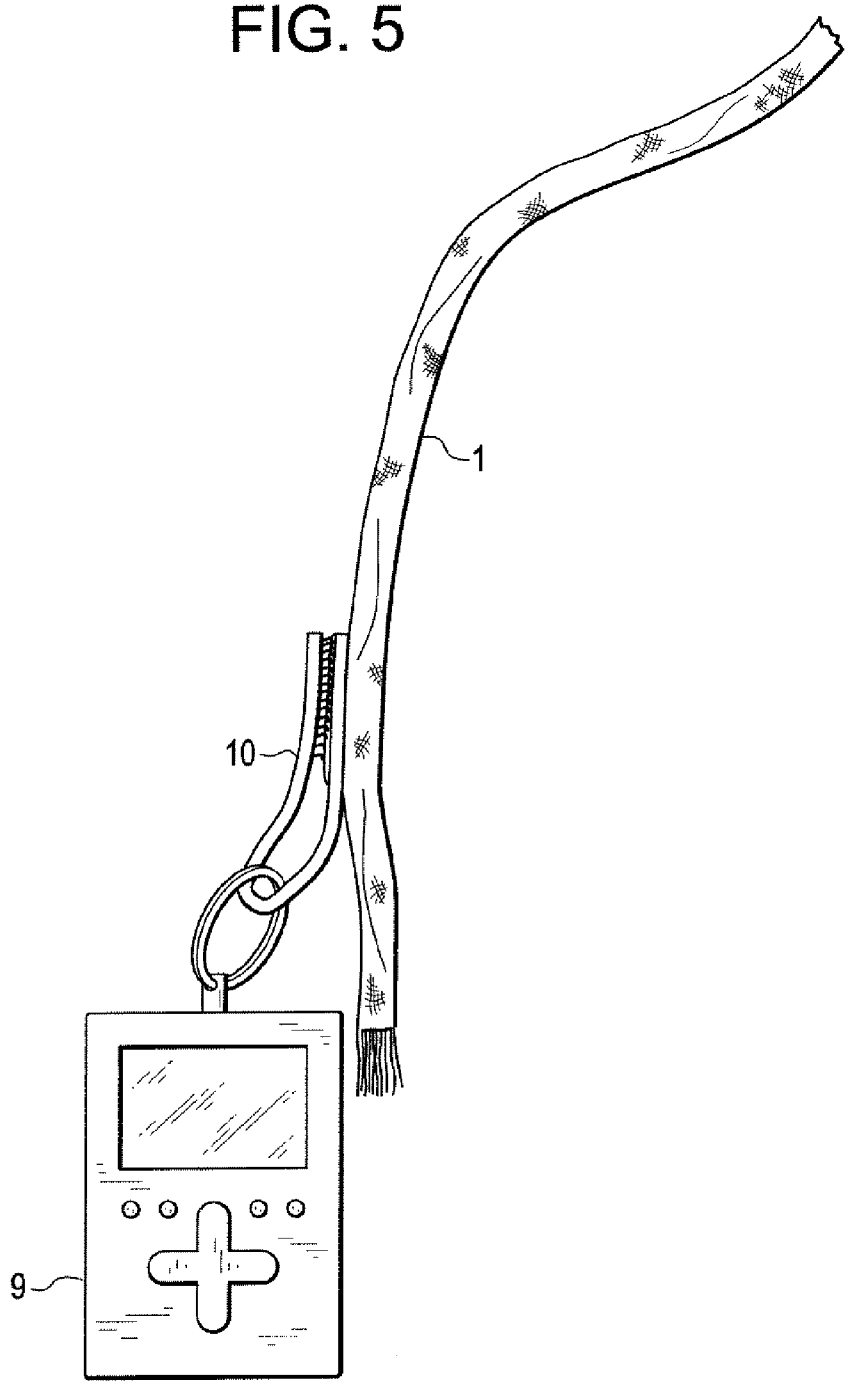
FIG. 5 illustrates an exemplary means for affixing an interactive toy to a scarf.

FIG. 5 illustrates scarf 1 having hooks and loops attaching means 10 sewn to scarf 1, and attached to the hooks and loops attachments means is an interactive electronic gadget or toy 9. The electronic toy 9 can be easily removed from the scarf 1 so that the scarf can be washed and cleaned without damaging the electronic gadget 9.

An interactive toy can be mechanical, electro-mechanical, or electronic devices. Example of preferred devices are whistles, electronic action figures, Personal Digital Assistant (PDA), wireless communication devices, electronic pets, voice recorder, and the like.

The ornamental toys may include small soft toys, plush stuffed animals, dolls, or other objects that are safe for children. Further, the toys may include teaching aids, miniature storybooks, numbers, letters, shapes, with various colors and designs to stimulate the mind of the wearers.

Not being limited to the scarf shown in FIG. 3, FIG. 4, and FIG. 6, the ends of the scarf to which the toys are affixed may be squared-off, pointed, gathered, rolled, fringed, or finished in any other fashionable manner.

As can be seen in the illustrated embodiments, there are no means provided for attaching one end of the scarf to another. The scarf of the present invention may be worn lying flat with each end hanging separately on either side of the wearer's neck. No fastening implements would be needed as the weight of the objects functionally keep the scarf balanced and secured to the wearer's body.

In the present invention the scarf is advantageously held in place without resorting to means of a cup and barrel apparatus, a ring, a clip, or the like and without attaching the ends to one another. The scarf of the present invention provides a safe method for securing a scarf in place without any fastening means that would be impractical for children or people with insufficient dexterity to secure the scarf by a mechanical fastening means.

Further by way of the present invention children can wear a scarf with the risk of strangulation minimized by the absence of mechanical fastening devices.

In the embodiment shown, the scarf of the present invention becomes more than just a piece of apparel, rather it also serves as a mobile entertainment center. The scarf of the present invention is fundamentally different from all the scarves that have come before, which had fringe or tassels attached to the ends which were solely intended for decoration. The objects combined with the scarf in a strategic location are specifically intended to entertain and be interactive with the wearer. Because of this unique entertainment feature, the present invention makes wearing a scarf more desirable, and, thus, serves as a parental aid to keep the children warm. The ornamental toys or interactive toys are also specifically intended as means to prevent a scarf from flying or slipping off the wearer's body.

The scarf of the present invention is not limited to having a single weighted object attached to each end. Instead, the scarf can have more than one weighted object attached to each end of the scarf.

As various possible embodiments may be made in the above invention for use for different purposes and as various changes might be made in the embodiments and method set forth above, it is understood that all of the above matters here set forth or shown in the accompanying drawings are to be interpreted as illustrative and not in a limiting sense.

What is claimed is:

1. A scarf made of a wearable material to provide warmth and shelter from the elements, comprising:

at least one weighted object attached externally to one distal end of the scarf; and at least one weighted object attached externally to another distal end of the scarf, wherein the weighted objects have a higher density than the wearable material of the scarf, wherein the weighted objects are of a result-effective weight sufficient to hold the scarf on a wearer's body without a fastening device when the scarf is worn on the body, and wherein the weighted objects are toys selected from a group consisting of a whistle, action figure, electronic gaming device, organizer, plush figure, storybook, number and letter.

2. The scarf according to claim 1, wherein the weighted objects are permanently attached to the scarf.

3. The scarf according to claim 1, wherein the weighted objects are removably attached to the scarf.

4. The scarf according to claim 3, further comprising:

a fastening means for removably attaching the weighted object to the scarf.

5. The scarf according to claim 1, wherein the weighted objects are approximately equal in weight.

6. The scarf according to claim 1, wherein the weighted objects have a total mass in a preferred range of half an ounce to 32 ounces.

7. The scarf according to claim 6, wherein the total mass is preferably in the range of 1 ounce to 12 ounces.

8. The scarf according to claim 7, wherein the total mass is more preferably in the range of 2 to 8 ounces.

* * * * *